US008389880B2

(12) United States Patent
Lee

(10) Patent No.: US 8,389,880 B2
(45) Date of Patent: Mar. 5, 2013

(54) KEYLOCK DEVICE FOR CIRCUIT BREAKER

(75) Inventor: Jae Yong Lee, Chungcheongbuk-Do (KR)

(73) Assignee: LS Industrial Systems Co., Ltd., Anyang-Si, Gyeonggi-Do (KR)

( * ) Notice: Subject to any disclaimer, the term of this patent is extended or adjusted under 35 U.S.C. 154(b) by 320 days.

(21) Appl. No.: 12/945,788

(22) Filed: Nov. 12, 2010

(65) Prior Publication Data

US 2011/0114458 A1 May 19, 2011

(30) Foreign Application Priority Data

Nov. 19, 2009 (KR) ..... 10-2009-0112223

(51) Int. Cl.
*H01H 9/28* (2006.01)

(52) U.S. Cl. ..... 200/43.11; 200/43.14; 200/4

(58) Field of Classification Search ..... 200/43.01, 200/43.11, 43.14–43.16, 50.01, 50.02, 50.09, 200/50.11, 400, 401, 293, 321, 322, 334
See application file for complete search history.

(56) References Cited

U.S. PATENT DOCUMENTS

| | | | | |
|---|---|---|---|---|
| 6,989,499 | B2 * | 1/2006 | Bortolloni et al. | 200/50.05 |
| 7,943,873 | B2 * | 5/2011 | Gopikrishnan et al. | 200/43.14 |
| 8,106,316 | B2 * | 1/2012 | Manz | 200/43.11 |
| 8,183,479 | B2 * | 5/2012 | Mittu et al. | 200/43.14 |
| 2006/0042922 | A1 * | 3/2006 | Aber et al. | 200/430 |
| 2008/0277249 | A1 * | 11/2008 | Zubieta et al. | 200/43.11 |

FOREIGN PATENT DOCUMENTS

| | | |
|---|---|---|
| JP | 63-060236 | 4/1988 |
| JP | 2005228713 | 8/2005 |

* cited by examiner

*Primary Examiner* — Michael Friedhofer
(74) *Attorney, Agent, or Firm* — Lee, Hong, Degerman, Kang & Waimey

(57) ABSTRACT

Disclosed is a keylock device for a circuit breaker. The keylock device for a circuit breaker comprises a closing lever configured to generate a closing operation of a mechanism, a trip lever configured to generate a trip operation of the mechanism, and a locking unit configured to allow a locked state of the locking unit to be maintained when the mechanism is in an 'ON' state, but to allow the locked state of the locking unit to be converted into a released state when the mechanism is in an 'OFF' state. Under these configurations, it is impossible to convert the current state of the keylock device into a locked state unless the mechanism of the circuit breaker is converted into an 'OFF' state. This may prevent the occurrence of an accidence due to the operator's unintentional 'OFF' state of the mechanism.

16 Claims, 13 Drawing Sheets

KEYLOCK DEVICE FOR CIRCUIT BREAKER

CROSS-REFERENCE TO A RELATED APPLICATION

Pursuant to 35 U.S.C. §119(a), this application claims the benefit of earlier filing date and right of priority to Korean Application No. 10-2009-0112223, filed on Nov. 19, 2009, the content of which is incorporated by reference herein in its entirety.

BACKGROUND OF THE INVENTION

1. Field of the Invention

The present invention relates to a circuit breaker, and particularly, to a keylock device for a circuit breaker capable of preventing a main circuit from being arbitrarily closed again or tripped.

2. Background of the Invention

Generally, a circuit breaker is an apparatus for opening and closing an electric circuit so as to protect a load device and a circuit line from an accidental current due to an abnormal current such as short circuit, from a power plant or a substation to a user's electric equipments. This circuit breaker is classified into an alternating current (AC) circuit breaker and a direct current (DC) circuit breaker according to an application method to a circuit line, and is classified into a vacuum circuit breaker, a gas circuit breaker, etc. according to an extinguishing medium.

The circuit breaker is provided with a keylock device for mechanically locking the circuit breaker when the circuit breaker is in an 'OFF' state. The keylock device prevents the circuit breaker from being operated by any operator, by preventing the circuit breaker which is in an 'OFF' state from being in an 'ON' state unless an operator having a key releases a locked state. Accordingly, the keylock device for the circuit breaker has to have a structure to mechanically lock the circuit breaker with enhanced reliability and stability.

FIGS. 1 to 4 are views showing a keylock device for a circuit breaker in accordance with the conventional art.

As shown, the conventional circuit breaker comprises an opening lever 11 disposed to be rotatable between a closing position in which a fixed contact and a movable contact contact each other, and a breaking position in which the fixed contact and the movable contact are separated from each other; a trip arm 12 extendingly-formed at one side of the opening lever 11; a trip latch 13 disposed to contact or be separated from one side of the trip arm 12, and configured to allow or prevent rotation of the trip arm 12; a breaking spring (not shown) connected to one side of the opening lever 11 so as to be contracted or extended, and configured to apply an elastic force to the opening lever 11 such that the opening lever 11 rotates to a breaking position; a driving cam 14 rotatable centering around a rotation shaft disposed in parallel to a rotation shaft of the opening lever 11; a driving arm 15 rotatable by interworking with the driving cam 14, and having one end connected to the opening lever 11 by a plurality of links (not shown); a closing spring (not shown) connected to another end of the driving arm 15 so as to be contracted or extended, and configured to apply an elastic force to the driving arm 15 such that the driving arm 15 rotates to a closing position; and a closing lever 16 disposed at one side of the driving cam 14 so as to contact or be separated from the driving cam 14, and configured to allow or prevent rotation of the driving cam 14.

A roller 16*a* is coupled to the end of the closing lever 16 so as to roll-contact the driving cam 14, and a closing solenoid 17 configured to rotate the closing lever 16 is provided at one side of the closing lever 16.

A trip lever 18 configured to operate the trip latch 13 is rotatably installed at one side of the trip latch 13, and a trip solenoid 19 configured to rotate the trip lever 18 is provided at one side of the trip lever 18.

The closing lever 16 and the trip lever 18 are spacing from each other by a predetermined distance in upper and lower directions. And, a locking unit 20 configured to limit the operation of the closing lever 16 is installed between the closing lever 16 and the trip lever 18.

As shown in FIG. 2, the locking unit 20 consists of a key portion disposed in parallel to a rotation shaft of the opening lever 11, and moveable to a locking position or a releasing position, and a locking lever 22 rotatably coupled to the key portion 21, and configured to limit the operation of the closing lever 16 while rotating along a rotation direction of the key portion 21.

Unexplained reference numeral 23 denotes a key, and 24 denotes a locking pin.

The operation to open the circuit breaker by an operator will be explained as follows.

In order to check and repair a circuit line by an operator, power is supplied to the trip solenoid 19 such that the fixed contact and the movable contact of the circuit breaker are separated from each other. Once the trip solenoid 19 is supplied with power, the trip latch 13 rotates centering around a rotation shaft so as to be spacing from the end of the trip arm 12, and the opening lever 11 being provided with a tensile force rotates centering around a rotation shaft. Accordingly, the movable contact is separated from the fixed contact.

As shown in FIG. 3, if the operator inserts a key 23 into the key portion 21 thus to rotate the key into a locking position, the locking lever 22 rotates in a direction to restrict rotation of the closing lever 16. Here, the end of the trip latch 13 maintains a spacing state from the trip arm 12 by the locking lever 22. Accordingly, the operator withdraws the key 23 from the key portion 21 so as to prevent a main circuit from being closed by another operator.

Once the circuit line has been completely repaired and/or checked, as shown in FIG. 4, the operator inserts the key 23 into the key portion 21 thus to rotate the key 23 to a releasing position. As a result, the locking lever 22 is restored to the initial position by an elastic force of a trip latch spring (not shown). In this state, if power is supplied to the closing solenoid 17, the closing lever 16 rotates to be spacing from the driving cam 14, and the opening lever 11 rotates by an elastic force of the closing spring (not shown). Accordingly, the movable contact contacts the fixed contact, resulting in an 'ON' state of the mechanism.

However, the conventional circuit breaker may have the following problems.

When the current state of the locking unit is converted into a locked state from a released state in a state that the mechanism of the circuit breaker is in an 'ON' state, the mechanism is converted into an 'OFF' state. This may cause a main circuit of the circuit breaker to be broken against the operator's intention. More concretely, in order to prevent accidents due to an arbitrary operation, the operator has to withdraw the key after turning off the circuit breaker and converting the current state of the locking unit into a locked state. However, the conventional keylock device is configured to convert the current state of the locking unit into a locked state without turning off the circuit breaker. In this case, the circuit breaker may be turned off, and the main circuit may be suddenly broken. This undesirable breaking may cause accidents.

SUMMARY OF THE INVENTION

Therefore, an object of the present invention is to provide a keylock device for a circuit breaker capable of preventing a mechanism to be turned 'OFF' due to unintentional manipulations of a locking unit unless the mechanism is tripped by an operator.

To achieve these and other advantages and in accordance with the purpose of the present invention, as embodied and broadly described herein, there is provided a keylock device for a circuit breaker, comprising: a closing lever configured to generate a closing operation of a mechanism; a trip lever configured to generate a trip operation of the mechanism; and a locking unit configured to restrict the closing operation of the closing lever, wherein the locking unit is configured to allow a locked state of the locking unit to be maintained when the mechanism is in an 'ON' state, but to allow the locked state of the locking unit to be converted into a released state when the mechanism is in an 'OFF' state.

According to another aspect of the present invention, there is provided a keylock device for a circuit breaker, comprising: an opening lever provided at a base plate so as to be rotatable between a closing position in which a fixed contact and a movable contact contact each other, and a breaking position in which the fixed contact and the movable contact are separated from each other; a closing lever mechanically connected to the opening lever, and rotatably provided at the base plate such that the opening lever rotates in a closing direction; and a locking unit provided at the base plate, and disposed between the opening lever and the closing lever such that rotation of the opening lever or the closing lever is selectively limited, wherein the locking unit comprises a key fixing plate fixed to the base plate, and having a key assembly at a center thereof; a hook plate coupled to one end of the key assembly, and provided to be rotatable with respect to the key fixing plate; a closing lock plate coupled to one end of the hook plate, and configured to selectively limit rotation of the closing lever while up-down moving along a rotation direction of the hook plate; a connecting link coupled to another end of the hook plate, and up-down moving in an opposite direction to the up-down direction of the closing lock plate; and a lock stopping plate rotatably coupled to the connecting link, slidably coupled to the base plate, and configured to selectively limit rotation of the opening lever while moving in a direction to relatively move with respect to the opening lever along a rotation direction of the hook plate.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 8 to 13 are perspective views showing an operation of the keylock device according to the present invention, in which FIGS. 8 and 9 are views showing an 'OFF' state of a mechanism in a locked state;

FIGS. 10 and 11 are views showing an 'ON' state of a mechanism in a locked state; and FIGS. 12 and 13 are views showing an 'OFF' state of a mechanism in a released state.

DETAILED DESCRIPTION OF THE INVENTION

Figure 1:
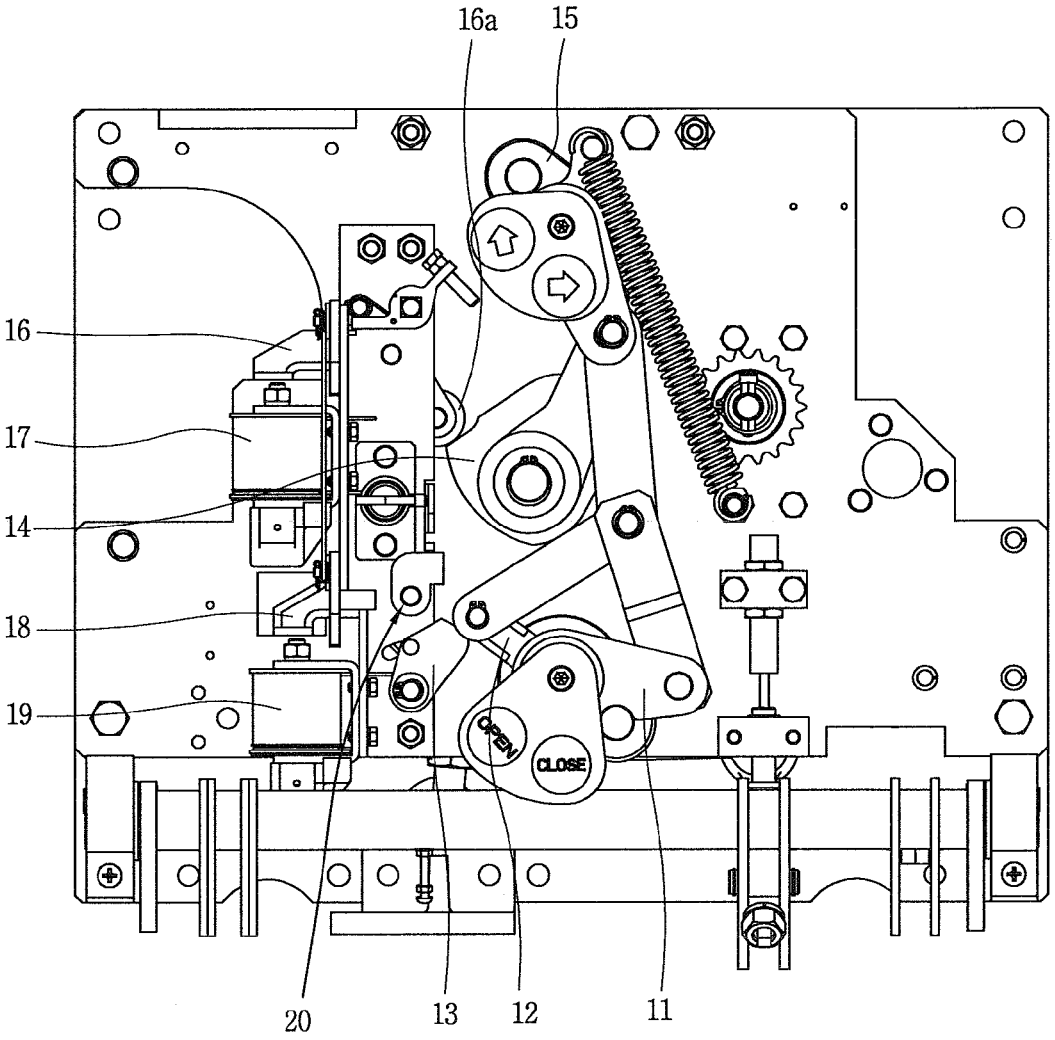
FIG. 1 PRIOR ART
FIG. 1 is a planar view of a circuit breaker having a keylock device in accordance with the conventional art.
Figure 2:
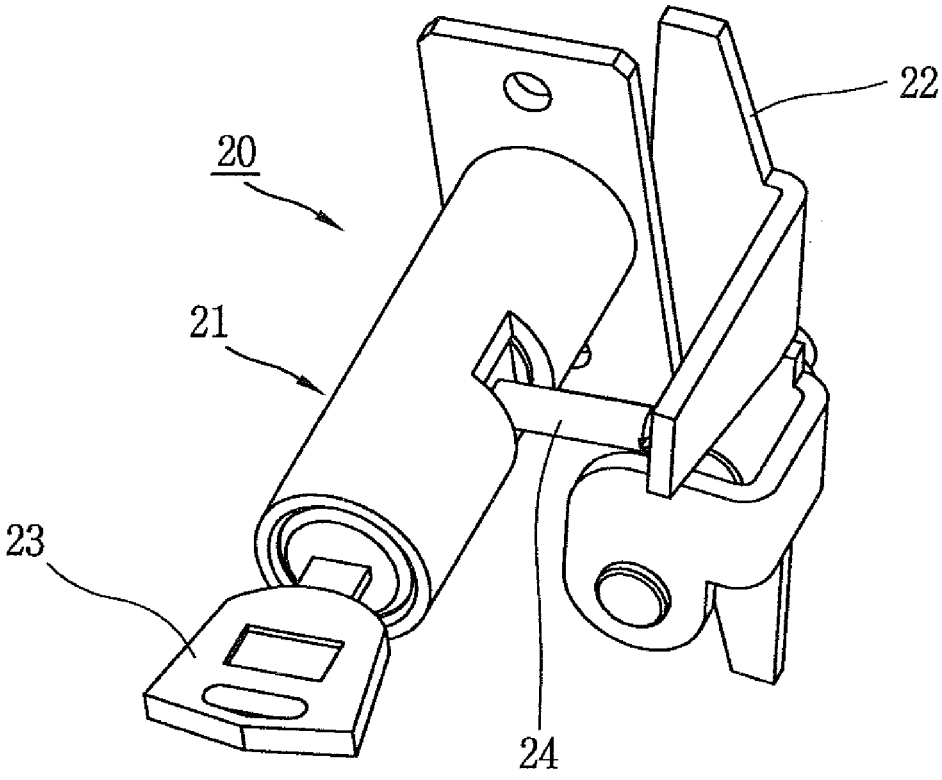
FIG. 2 PRIOR ART
FIG. 2 is a perspective view of the keylock device of FIG. 1.
Figure 3:
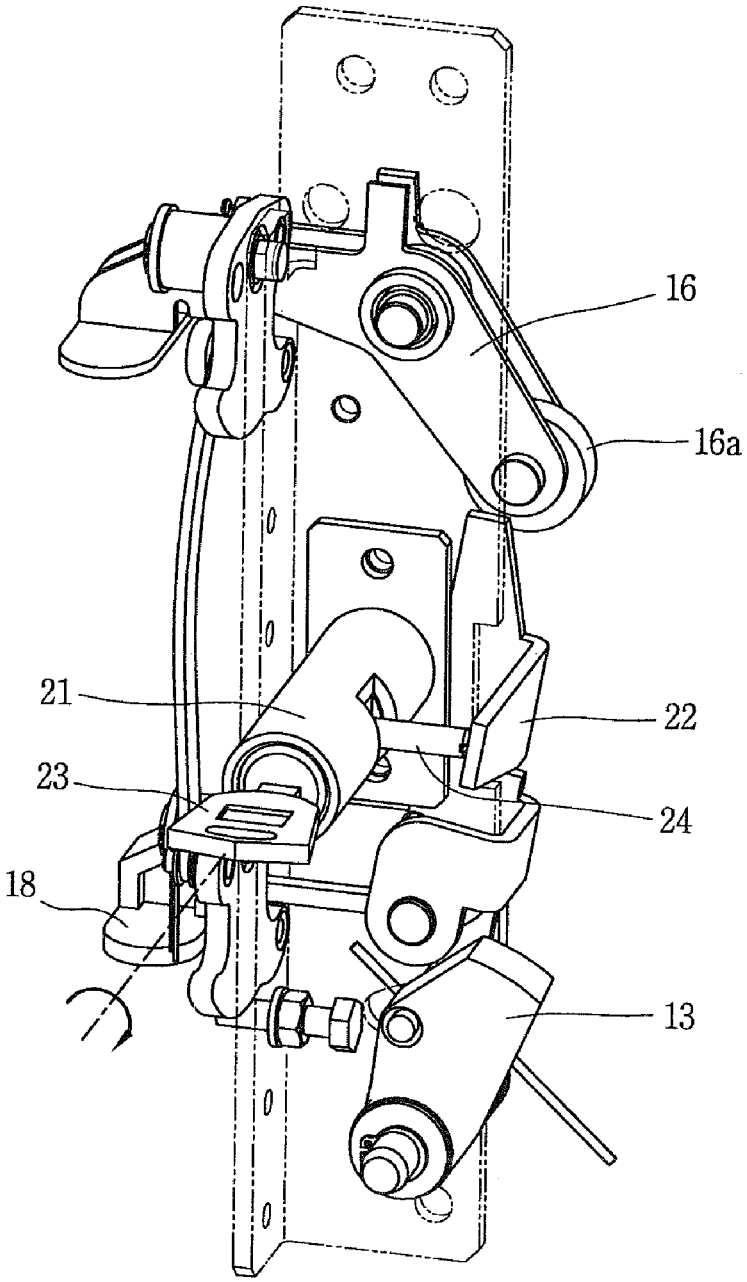
FIG. 3 PRIOR ART
FIGS. 3 and 4 are perspective views showing an operation of the keylock device of FIG. 1.
Figure 4:
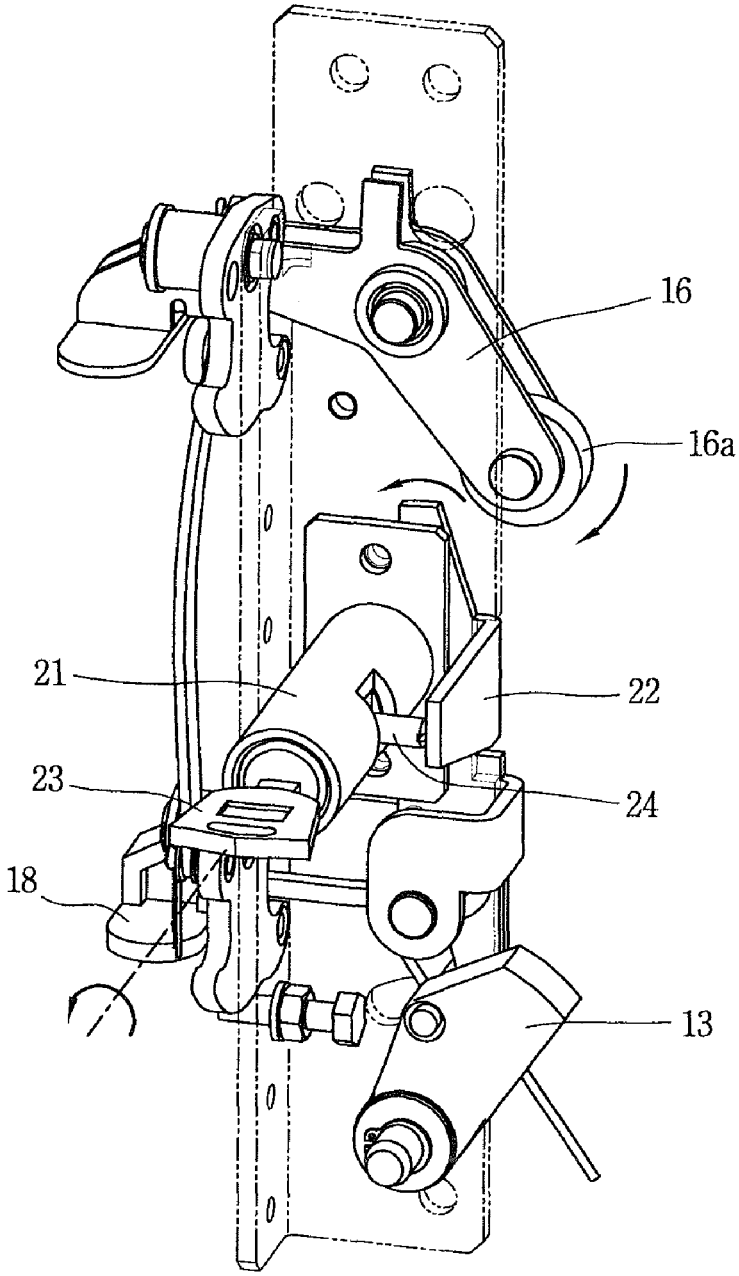
FIG. 4 PRIOR ART

Description will now be given in detail of the present invention, with reference to the accompanying drawings.

For the sake of brief description with reference to the drawings, the same or equivalent components will be provided with the same reference numbers, and description thereof will not be repeated.

Hereinafter, a keylock device for a circuit breaker according to the present invention will be explained in more detail with reference to the attached drawings. Same or similar components as/to the aforementioned components will be provided with the same reference numerals, and detailed explanations thereof will be omitted.

Figure 5:
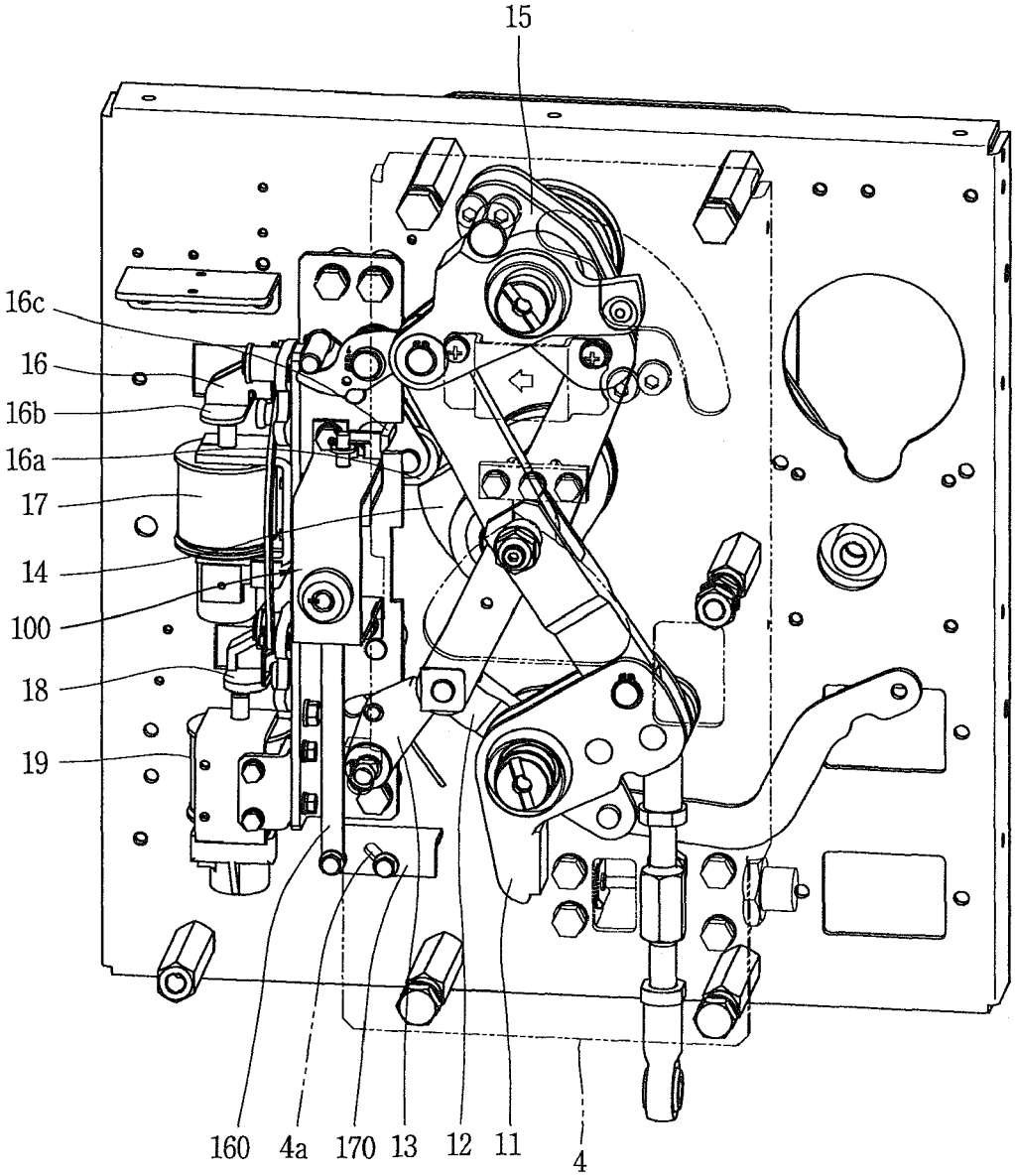
FIG. 5 is a perspective view of a circuit breaker having a keylock device according to the present invention.
Figure 6:
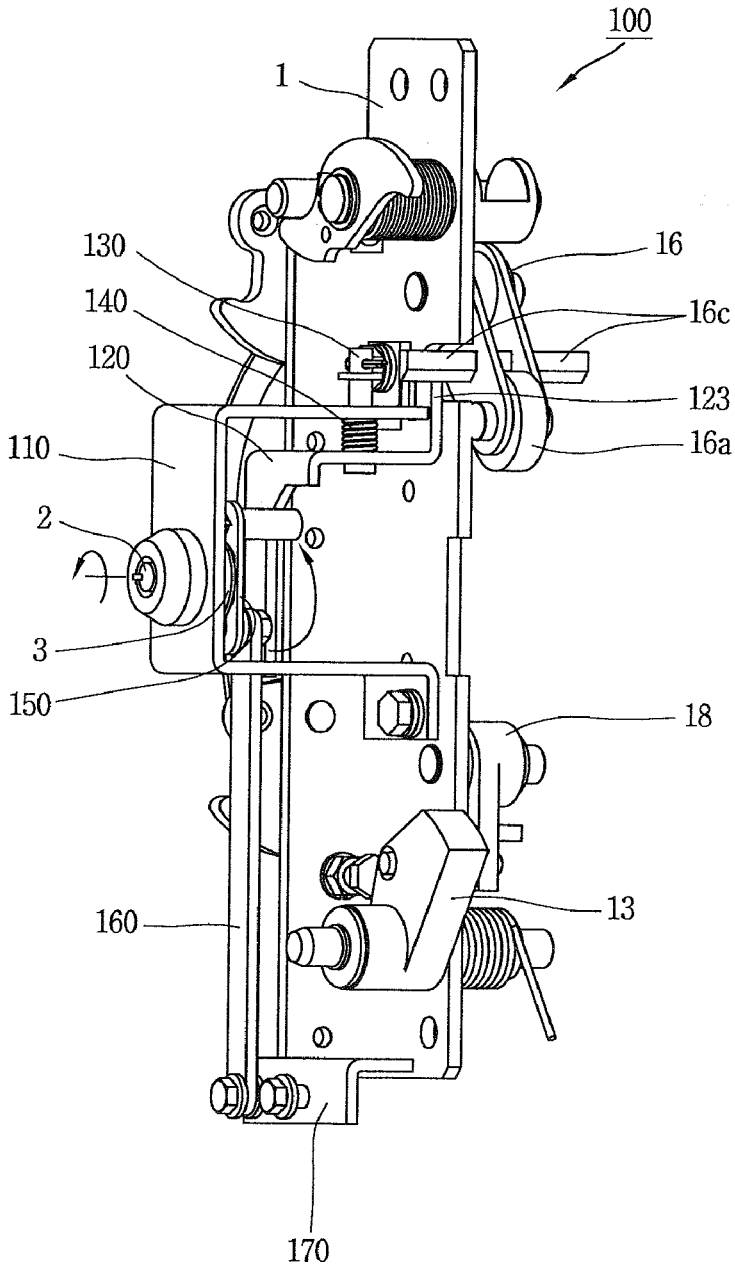
FIG. 6 is a perspective view of the keylock device of FIG. 5.
Figure 7:
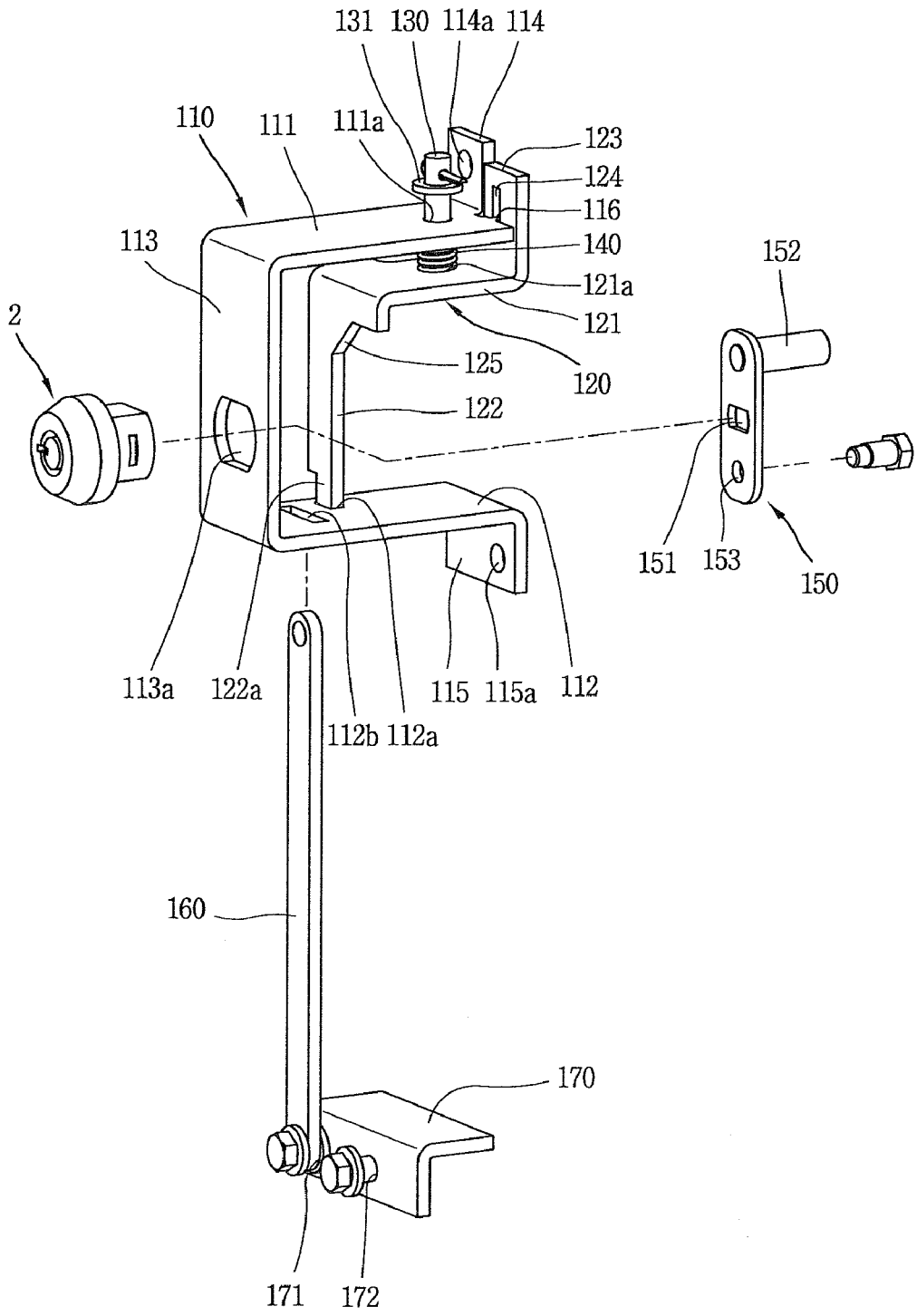
FIG. 7 is a disassembled perspective view of the keylock device of FIG. 6.

FIG. 5 is a perspective view of a circuit breaker having a keylock device according to the present invention, FIG. 6 is a perspective view of the keylock device of FIG. 5, FIG. 7 is a disassembled perspective view of the keylock device of FIG. 6, and FIGS. 8 to 13 are perspective views showing an operation of the keylock device according to the present invention.

As shown in FIG. 5, the circuit breaker according to the present invention comprises an opening lever 11, a trip arm 12, a trip latch 13, a breaking spring (not shown), a driving cam 14, a driving arm 15, a closing spring (not shown), a closing lever 16, a closing solenoid 17, a trip lever 18, and a trip solenoid 19. A locking unit 100 configured to limit a closing operation and a trip operation of the circuit breaker is installed between the closing lever 16 and the trip lever 18.

Here, the opening lever 11, the trip arm 12, the trip latch 13, the breaking spring (not shown), the driving cam 14, the driving arm 15, the closing spring (not shown), the closing lever 16, the closing solenoid 17, the trip lever 18, the trip solenoid 19, etc. have similar or the same functions to/as those of the conventional ones, and thus detailed explanations thereof will be omitted.

In the present invention, the closing lever 16 has a changed structure so as to interwork with another components of the locking unit 100 to be later explained, which will be explained with reference to the attached drawings.

The closing lever 16 is formed in an approximate 'V' shape. A roller 16*a* is rotatably coupled to one end of the closing lever 16 so as to contact or be separated from the driving cam, and a driving end 16*b* configured to be operated by the closing solenoid 17 is curvedly-formed at another end of the closing lever 16. Locking pins 16*c* are protruding from both side surfaces of the closing lever 16 such that the closing lever 16 has limited rotation by selectively contacting a closing lock plate 120 of the locking unit 100 to be later explained between the roller 16*a* and the driving end 16*b*.

As shown in FIGS. 6 and 7, the locking unit 100 includes a key fixing plate 110 fixed to the base plate 1, and having a key assembly 2, a closing lock plate 120 slidably coupled to the key fixing plate 110, and constituting a first movable member, a guide pin 130 slidably coupled between the key fixing plate 110 and the closing lock plate 120, a restoration spring 140 inserted into the guide pin 130 so as to be positioned between the key fixing plate 110 and the closing lock plate 120, and configured to restore the closing lock plate 120 to the original position, a hook plate 150 coupled to the key assembly 2, rotated according to a key operation, and configured to restrict rotation of the closing lever 16 by up-down moving the closing lock plate 120, a connecting link 160 having one end rotatably connected to the hook plate 150, and constituting a second movable member, and a lock stopping plate 170 rotatably coupled to another end of the connecting link 160, constituting a locking member, and configured to restrict rotation of the opening lever 11 while horizontally moving along up-down movement of the closing lock plate 120.

The key fixing plate 110 is curvedly-formed in a handgrip shape. More concretely, the key fixing plate 110 includes an upper horizontal surface 111, a lower horizontal surface 112, and an intermediate vertical surface 113 at the time of a side surface projection. Coupling ends 114 and 115 are curvedly-formed at both ends of the key fixing plate 110 so as to be coupled to the base plate 1. The coupling ends 114 and 115 are provided with coupling openings 114*a* and 115*a* for coupling by bolts, respectively. A guide protrusion 116 slidably coupled to a guide groove 124 of the closing lock plate 120 to be later explained is formed at one side of the upper coupling end 114.

At the lower horizontal surface 112, formed are a first sliding hole 112*a* configured to slidably and vertically insert therein a sliding protrusion 122*a* of the closing lock plate 120 to be later explained, and a second sliding hole 112*b* configured to slidably and vertically insert therein the connecting link 160. At the upper horizontal surface 111, formed is a pin hole 111*a* configured to allow the guide pin 130 to slidably penetrate therethrough. At the intermediate vertical surface 113 of the key fixing plate 110, formed is a key assembly hole 113*a* configured to insertion-fix the key assembly 2 therein.

The key assembly 2 is formed such that a key body which constitutes the appearance thereof is inserted into the key assembly hole 113*a*. A front portion of the key body is formed with a step, thereby being fixed to a front surface of the periphery of the key assembly hole 113*a* in a locked manner. On the other hand, a rear portion of the key body is fixed to a rear surface of the periphery of the key assembly hole 113*a* by being locked by a key assembling clip 3. The key assembly 2 may have a structure in which a key may be or may not be withdrawn according to a rotation angle, i.e., a locked angle or an opened angle.

The closing lock plate 120 is formed to correspond to a half of the key fixing plate 110, i.e., is curvedly-formed to have a horizontal surface 121 and a vertical surface 122. A pin hole 121*a* is formed at an intermediate part of the horizontal surface 121 in correspondence to the pin hole 111*a* of the key fixing plate 110. A locking end 123 is curvedly-formed at an upper end of the horizontal surface 121 in correspondence to the upper coupling end 114 of the key fixing plate 110. The guide groove 124 configured to slidably insert the guide protrusion 116 of the key fixing plate 110 therein is long formed at the locking end 123 in an up-down moving direction. The sliding protrusion 122*a* is formed at another end of the closing lock plate 120 so as to be slidably inserted into the sliding hole 112*a* of the key fixing plate 110. And, a sliding surface 125 is formed at the vertical surface 122 of the closing lock plate 120 with inclination, such that the closing lock plate 120 is up-down moveable by contacting the driving pin 152 of the hook plate 150 to be later explained, and by sliding on the driving pin 152.

One end of the guide pin 130 is provided with a pin head portion (not shown) in correspondence to the pin hole 121*a* of the closing lock plate 120, and another end thereof is coupled to a locking member 131 such as a washer in correspondence to the pin hole 111*a* of the key fixing plate 110.

The restoration spring 140 is implemented as a compression coil spring, and is inserted into the guide pin 130 so as to be positioned between the key fixing plate 110 and the closing lock plate 120.

The hook plate 150 is formed to have a short length, and a key fixing hole 151 cut into a 'ㄷ' shape is formed at an intermediate part of the hook plate 150 such that the key body of the key assembly 2 is fixedly-coupled thereto. The driving pin 152 is fixedly-coupled to one side of the key fixing hole 151 in a direction to contact the sliding surface 125 of the closing lock plate 120. And, a link hole 153 to which the connecting link 160 is rotatably coupled is formed at another side of the key fixing hole 151.

The connecting link 160 is formed in a long frame shape. One end of the connecting link 160 is rotatably coupled to the link hole 153 of the hook plate 150, whereas another end of the connecting link 160 is rotatably coupled to the lock stopping plate 170 via the second sliding hole 112*b* of the key fixing plate 110.

The lock stopping plate 170 has a 'ㄱ'-shaped sectional surface of a predetermined length. A first coupling hole 171 rotatably coupled to the connecting link 160 is formed at one end of the lock stopping plate 170, and a second coupling hole 172 slidably coupled to a cover plate 4 of the circuit breaker is formed at another end of the lock stopping plate 170. A sliding hole 4*a* having a circular arc is formed at the cover plate 4 so that the lock stopping plate 170 can horizontally move by being rotated by the connecting link 160. The second coupling hole 172 of the lock stopping plate 170 is slidably coupled to the sliding hole 41 by a bolt.

The keylock device for a circuit breaker according to the present invention may have the following advantages.

In case of converting a current state of the mechanism into 'OFF' so as to check and repair a circuit line by an operator, power is supplied to the trip solenoid 19 so as to separate the fixed contact and the movable contact of the circuit breaker from each other. Then, the trip lever 18 rotates centering around a rotation shaft so as to be spacing from the end of the trip arm 13, and the opening lever 11 rotates centering around a rotation shaft by a breaking spring (not shown). As a result, the movable contact is separated from the fixed contact.

Figure 8:
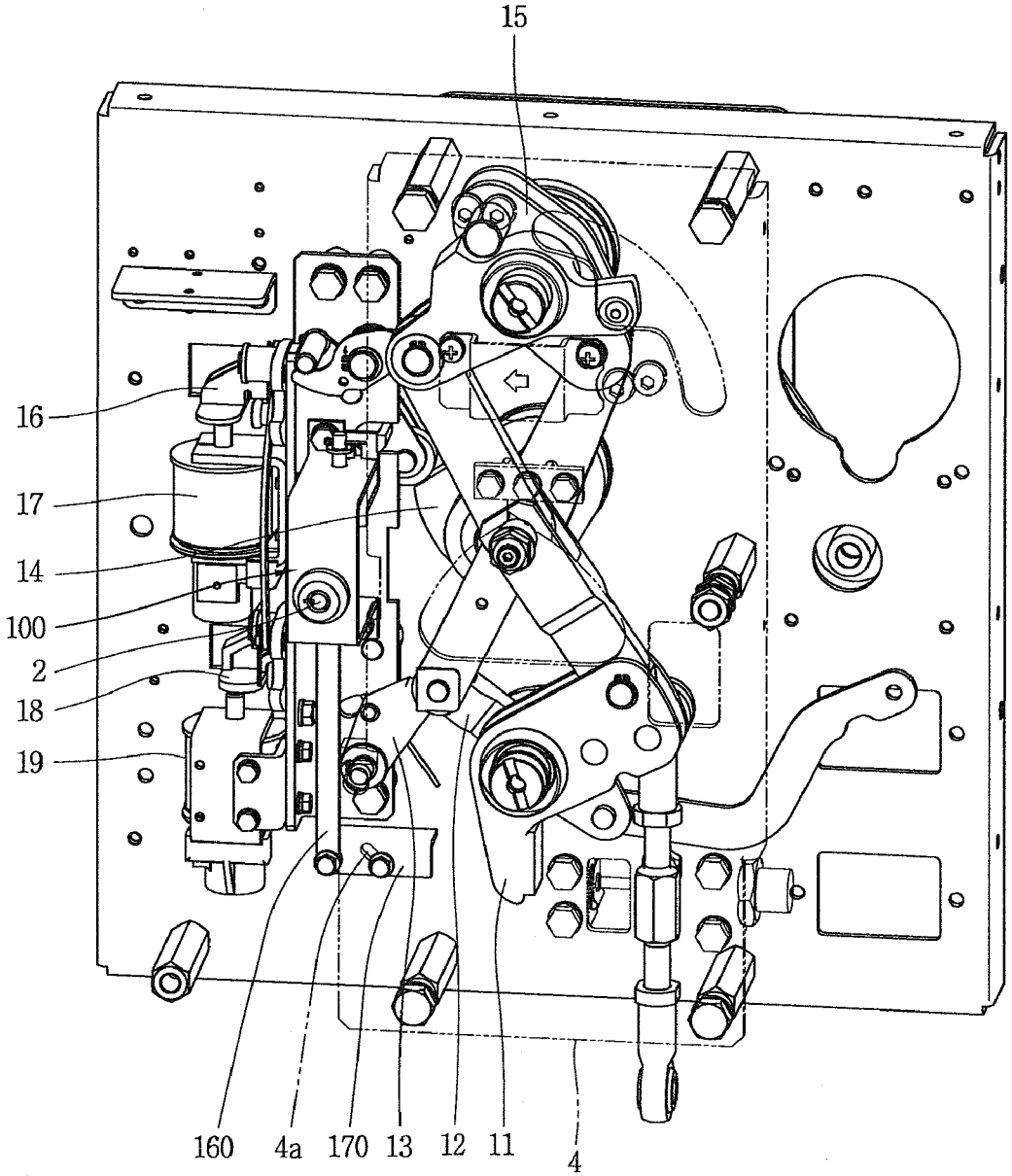
Figure 9:
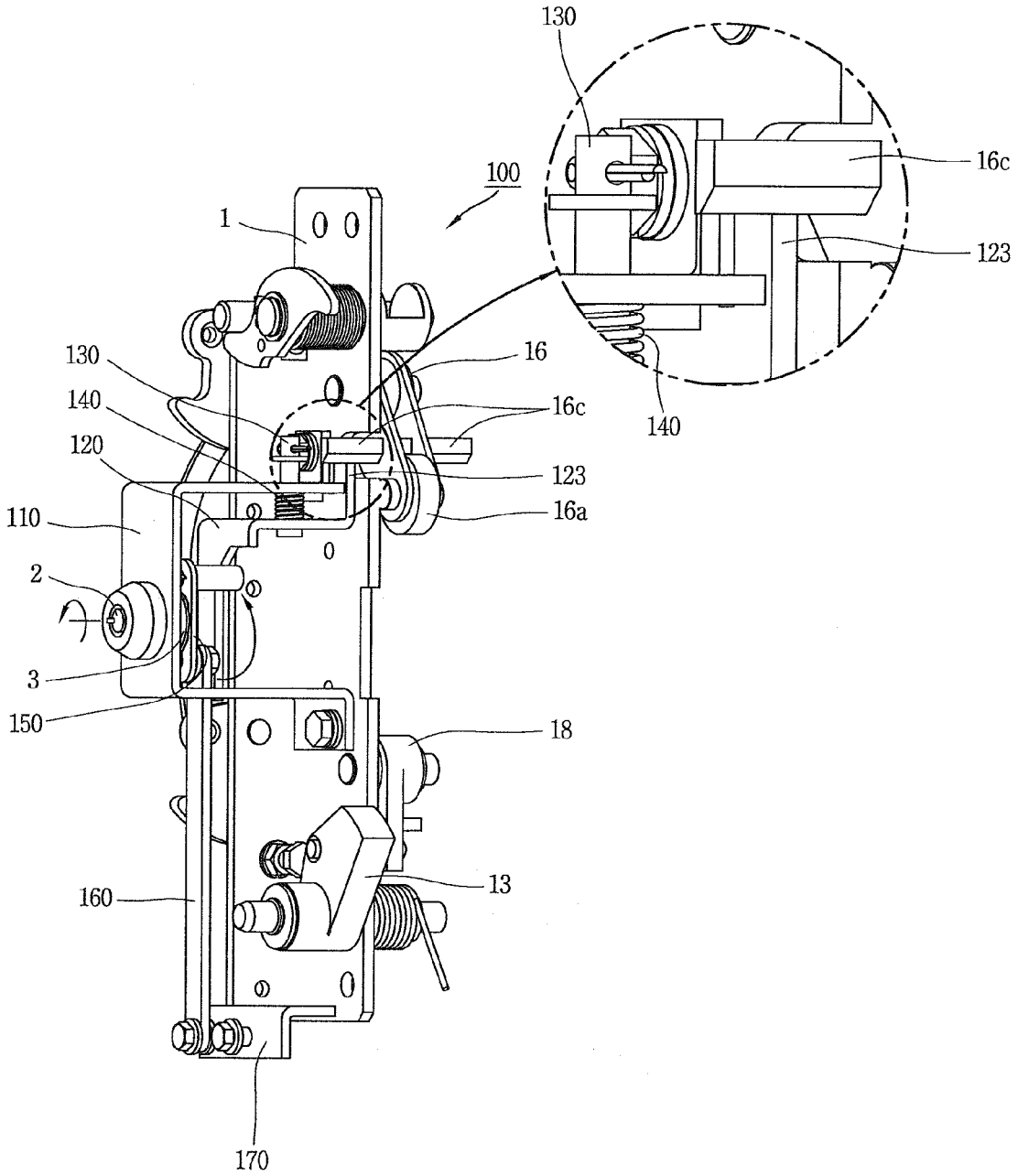

As shown in FIGS. 8 and 9, if the operator inserts a key in a key groove of the key assembly 2 and rotates the key in a locking direction, the hook plate 150 fixedly-coupled to the key assembly 2 is rotated in a counterclockwise direction. At the same time, the driving pin 152 pushes up the sliding surface 125 of the closing lock plate 120, so that the closing lock plate 120 is upwardly moved. Accordingly, the locking pin 16*c* of the closing lever 16 is locked by the locking end 123 of the closing lock plate 120. This may allow a closing operation of the closing lever 16 to be restricted.

At the same time, while the connecting link 160 coupled to the opposite side to the driving pin 152 on the basis of the key assembly 2 is downwardly moved, the lock stopping plate 170 is horizontally moved toward the opening lever 11. This may prevent rotation of the opening lever 11 by the lock stopping plate 170. As a result, the mechanism is prevented from being converted into a closing state.

Figure 10:
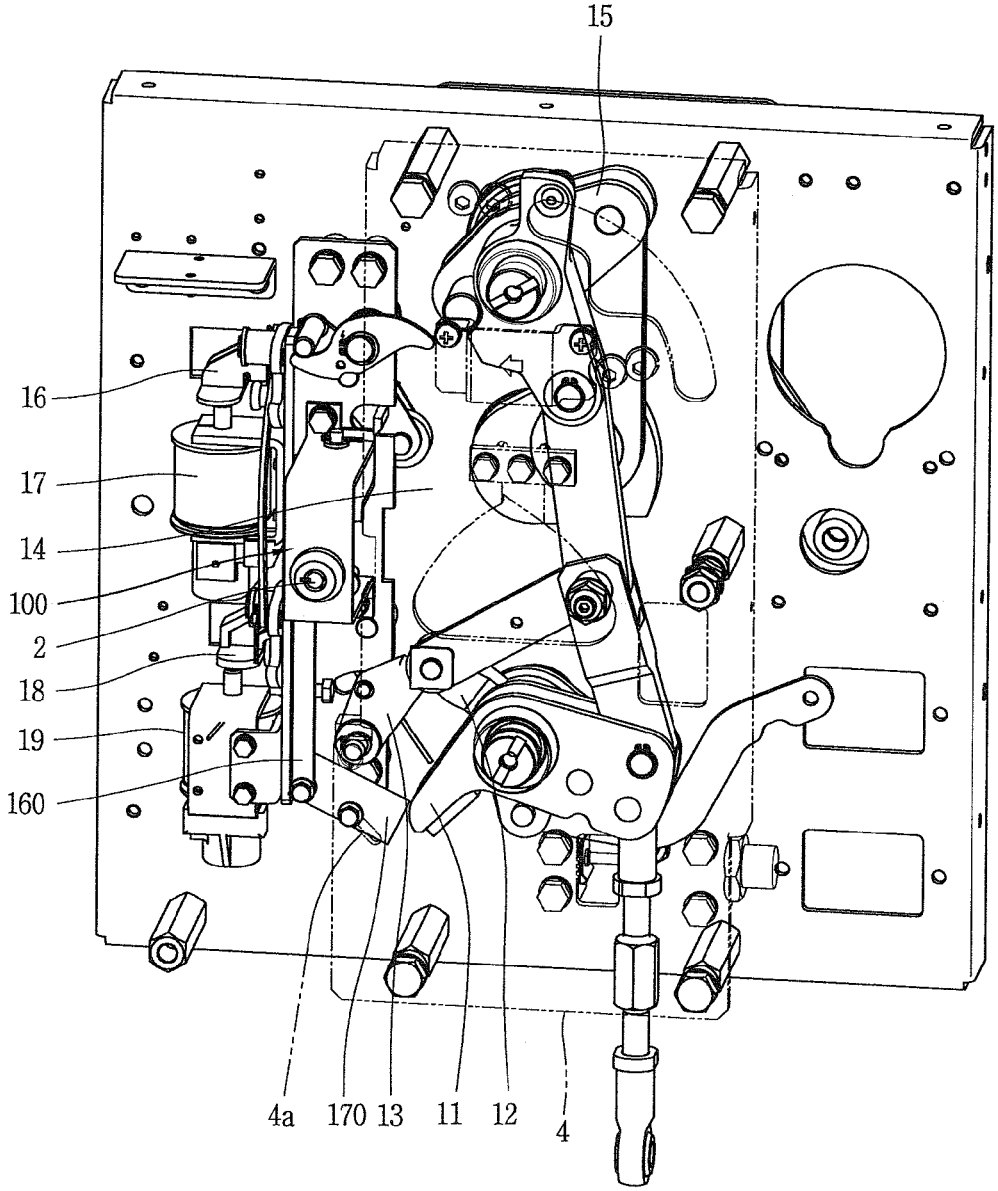
Figure 11:
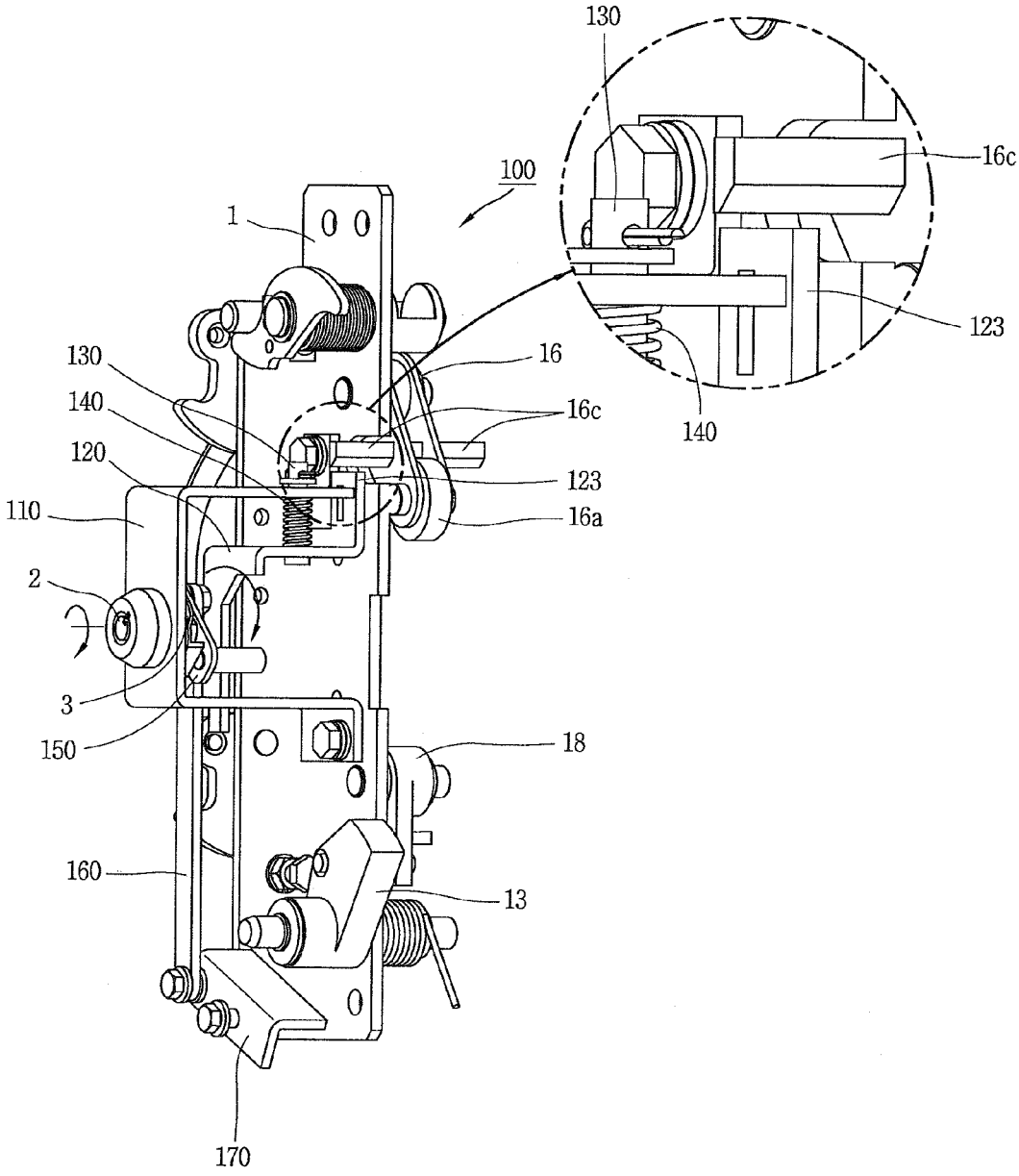

On the other hand, in case of converting the current state of the mechanism into a closing state again after the circuit line has been completely repaired and/or checked, the operator inserts the key into the key assembly 2 to rotate the key in a releasing direction, i.e., a clockwise direction as shown in FIGS. 10 and 11. Then, the hook plate 150 fixedly-coupled to the key assembly 2 is rotated in a clockwise direction. Then, the driving pin 152 in a state to push up the sliding surface 125 of the closing lock plate 120 is separated from the sliding surface 125, and downwardly moves by a restoration force of the restoration spring 140. As a result, the locking pin 16*c* of the closing lever 16 is not locked by the locking end 123 of the closing lock plate 120, but can be rotated. This may allow a closing operation of the closing lever.

At the same time, the connecting link 160 coupled to the hook plate 150 horizontally moves the lock stopping plate 160 toward a direction far from the opening lever 11 while upwardly moving. Then, the opening lever 11 is not locked by the lock stopping plate 170, thereby converting the current state of the mechanism to a closing state. In this state, if power is supplied to the closing solenoid 17 by the operator, the closing lever 16 rotates to be spacing from the driving cam 14. At the same time, the opening lever 11 rotates by an elastic force of a closing spring (not shown) so that the fixed contact and the movable contact can contact each other.

Figure 12:
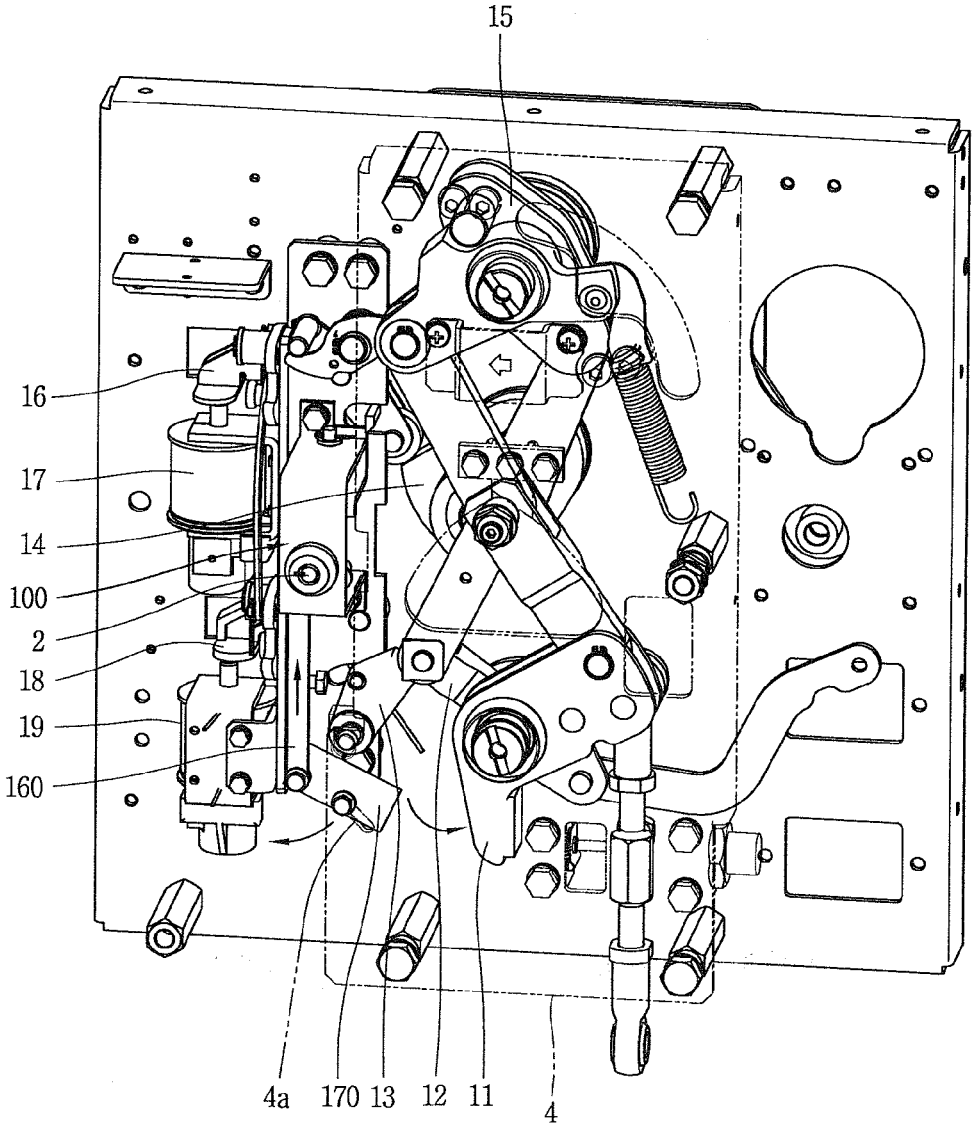
Figure 13:
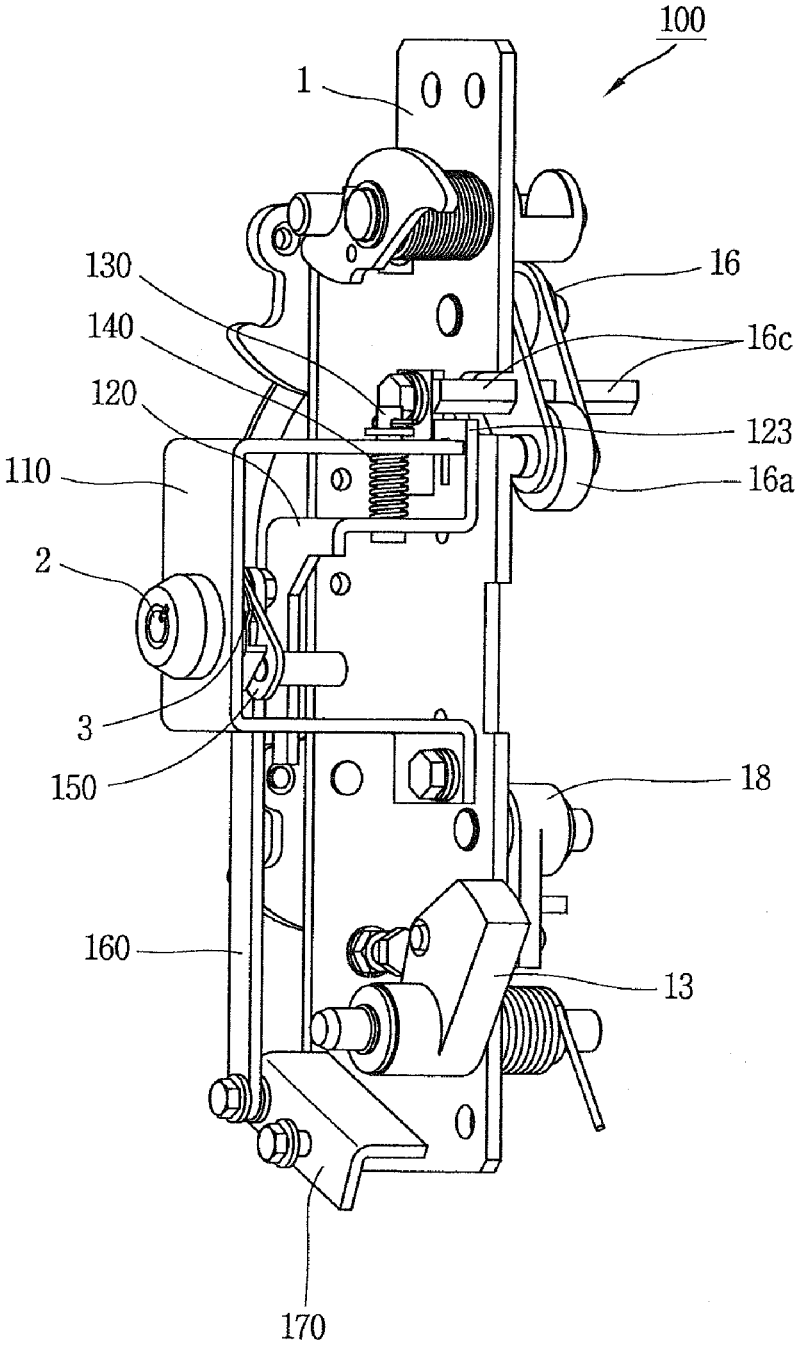

When the operator is to convert the current state of the keylock device into a locked state by mistake in a state that the circuit breaker is in a closing state, horizontal movement of the lock stopping plate 170 is prevented as shown in FIGS. 12 and 13. Accordingly, it is impossible to convert the current state of the keylock device into a locked state unless the mechanism of the circuit breaker is converted into an 'OFF' state.

This may prevent the occurrence of an accidence due to an 'OFF' state of the mechanism caused by the operator's unintentional manipulation.

The keylock device for a circuit breaker according to the present invention may be applied to a circuit breaker used in a power plant or a substation.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A keylock device for a circuit breaker, comprising:

a closing lever configured to generate a closing operation of a mechanism;

a trip lever configured to generate a trip operation of the mechanism; and a locking unit configured to restrict the closing operation of the closing lever, wherein the locking unit is configured to allow a locked state of the locking unit to be maintained when the mechanism is in an 'ON' state, but to allow the locked state of the locking unit to be converted into a released state when the mechanism is in an 'OFF' state.

2. The keylock device for a circuit breaker of claim 1, wherein the locking unit is provided with a first sliding member and a second sliding member linearly moving in opposite directions according to a rotation direction of a key, wherein the first sliding member selectively limits rotation of the closing lever, whereas the second sliding member selectively limits 'ON/OFF' of the mechanism turned on/off by operations of the closing lever and the trip lever.

3. The keylock device for a circuit breaker of claim 2, wherein a locking member is rotatably coupled to the end of the second sliding member, and the locking member moves to a direction perpendicular to the second sliding member while rotating along a sliding direction of the second sliding member, thereby selectively limiting 'ON/OFF' of the mechanism.

4. A keylock device for a circuit breaker, comprising:

an opening lever provided at a base plate so as to be rotatable between a closing position in which a fixed contact and a movable contact contact each other, and a breaking position in which the fixed contact and the movable contact are separated from each other;

a closing lever mechanically connected to the opening lever, and rotatably provided at the base plate such that the opening lever rotates in a closing direction; and a locking unit provided at the base plate, and disposed between the opening lever and the closing lever such that rotation of the opening lever or the closing lever is selectively limited, wherein the locking unit comprises:

a key fixing plate fixed to the base plate, and having a key assembly at a center thereof;

a hook plate coupled to one end of the key assembly, and provided to be rotatable with respect to the key fixing plate;

a closing lock plate coupled to one end of the hook plate, and configured to selectively limit rotation of the closing lever while up-down moving along a rotation direction of the hook plate;

a connecting link coupled to another end of the hook plate, and up-down moving in an opposite direction to the up-down direction of the closing lock plate; and a lock stopping plate rotatably coupled to the connecting link, slidably coupled to the base plate, and configured to selectively limit rotation of the opening lever while moving in a direction to relatively move with respect to the opening lever along a rotation direction of the hook plate.

5. The keylock device for a circuit breaker of claim 4, wherein the key fixing plate is provided with a key assembly hole at a center thereof, the key assembly hole for insertion-fixing the key assembly thereto.

6. The keylock device for a circuit breaker of claim 5, wherein one end of the key assembly is fixed to one side surface of the periphery of the key assembly hole in a locked manner, whereas another end thereof is fixed to another side surface of the periphery of the key assembly hole by being locked by a clip.

7. The keylock device for a circuit breaker of claim 4, wherein a guide protrusion and a guide groove are formed to be slidably coupled to each other between the key fixing plate and the closing lock plate.

8. The keylock device for a circuit breaker of claim 7, wherein the key fixing plate is provided with sliding holes into which one end of the closing lock plate is slidably inserted.

9. The keylock device for a circuit breaker of claim 4, wherein the hook plate is provided with a key fixing hole at a center thereof, the key fixing hole into which the key assembly is inserted to be fixed.

10. The keylock device for a circuit breaker of claim 9, wherein a driving pin configured to up-down move the closing lock plate by contacting the closing lock plate is provided at one side of the key fixing hole.

11. The keylock device for a circuit breaker of claim 10, wherein the connecting link is rotatably coupled to another side of the key fixing hole.

12. The keylock device for a circuit breaker of claim 4, wherein the closing lock plate is slidably coupled to the key fixing plate.

13. The keylock device for a circuit breaker of claim 12, wherein the closing lock plate has an inclined sliding surface so as to up-down move by selectively contacting the driving pin along a rotation direction of the hook plate.

14. The keylock device for a circuit breaker of claim 13, wherein an elastic member having an elastic force in a direction to restore the closing lock plate to an original position when the driving pin is separated from the sliding surface is provided between the key fixing plate and the closing lock plate.

15. The keylock device for a circuit breaker of claim 4, wherein a sliding hole is formed at the cover plate in a circular arc shape, such that the lock stopping plate is slidably coupled thereto in a direction to relatively move with respect to the opening lever along a rotation direction of the hook plate.

16. The keylock device for a circuit breaker of claim 4, wherein a locking pin is formed at the closing lever so as to receive force from the closing lock plate by being selectively detachable-mounted to the closing lock plate.

* * * * *